US011715881B2

(12) United States Patent
Brock

(10) Patent No.: US 11,715,881 B2
(45) Date of Patent: Aug. 1, 2023

(54) BLADE ANTENNA WITH ULTRA-UNIFORM AZIMUTHAL GAIN PATTERNS OVER A WIDE BANDWIDTH

(71) Applicant: United States of America as represented by the Secretary of the Navy, San Diego, CA (US)

(72) Inventor: David Walker Brock, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 21 days.

(21) Appl. No.: 17/546,415

(22) Filed: Dec. 9, 2021

(65) Prior Publication Data

US 2023/0187838 A1 Jun. 15, 2023

(51) Int. Cl.
*H01Q 13/08* (2006.01)
*H01Q 1/42* (2006.01)
*H01Q 1/28* (2006.01)

(52) U.S. Cl.
CPC ..... *H01Q 13/085* (2013.01); *H01Q 1/283* (2013.01); *H01Q 1/42* (2013.01)

(58) Field of Classification Search
CPC ..... H01Q 13/08; H01Q 13/085; H01Q 1/283
See application file for complete search history.

(56) References Cited

U.S. PATENT DOCUMENTS 8,736,506 B1 * 5/2014 Brock ..... H01Q 9/40 343/786
9,331,392 B1 * 5/2016 Bermeo ..... H01Q 13/10
2018/0115077 A1 * 4/2018 Tankielun ..... H01Q 13/085

* cited by examiner

*Primary Examiner* — Daniel Munoz
(74) *Attorney, Agent, or Firm* — Naval Information Warfare Center Pacific; Kyle Eppele; J. Eric Anderson

(57) ABSTRACT

A blade antenna comprising: an upper blade element made of conductive, planar material having a profile that curves upwardly from a centrally-located feed point; and a lower blade element made of conductive, planar material having a profile that curves downwardly from the feed point, wherein the lower blade element is configured to be connected to a ground and has a thickness that is at least three times a thickness of the upper blade element, and wherein the curved profiles of the upper and lower blade elements are disposed with respect to one another so as to form a tapered slot on each side of the feed point.

20 Claims, 15 Drawing Sheets

BLADE ANTENNA WITH ULTRA-UNIFORM AZIMUTHAL GAIN PATTERNS OVER A WIDE BANDWIDTH

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 111215.

BACKGROUND OF THE INVENTION

In today's wireless world, antennas are used in a variety of applications. It can be a challenge to find an antenna with the desired performance characteristics that also meets certain size and shape requirements for a given application. For example, antennas mounted to the exterior of an aircraft should have an aerodynamic shape with high mechanical strength to withstand the high speed of the aircraft, and to minimize the disturbance to the aerodynamics of the airplane. There is a need for an antenna with a small form factor, a more omnidirectional gain pattern, and with the ability to operate over a wide frequency range with less gaps, or nulls, in its gain patterns at certain frequencies.

SUMMARY

Disclosed herein is a blade antenna comprising upper and lower blade elements that are capable of transmitting and receiving radio frequency (RF) energy. The upper and lower blade elements are situated in a tapered slot antenna configuration, and a width of the lower blade element is at least three times a width of the upper blade element.

Another embodiment of the blade antenna may be described as comprising upper and lower blade elements made of conductive, planar material. The upper blade element has a profile that curves upwardly from a centrally-located feed point. The lower blade element has a profile that curves downwardly from the feed point. The lower blade element is configured to be connected to a ground and has a thickness that is at least three times a thickness of the upper blade element. The curved profiles of the upper and lower blade elements are disposed with respect to one another so as to form a tapered slot on each side of the feed point.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The blade antenna disclosed below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other embodiment of the blade antenna described herein as will be understood by one of ordinary skill in the art unless otherwise stated specifically.

References in the present disclosure to "one embodiment," "an embodiment," or any variation thereof, means that a particular element, feature, structure, or characteristic described in connection with the embodiments is included in at least one embodiment. The appearances of the phrases "in one embodiment," "in some embodiments," and "in other embodiments" in various places in the present disclosure are not necessarily all referring to the same embodiment or the same set of embodiments.

As used herein, the terms "comprises," "comprising," "includes," "including," "has," "having," or any variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of words such as "the," "a," or "an" are employed to describe elements and components of the embodiments herein; this is done merely for grammatical reasons and to conform to idiomatic English. This detailed description should be read to include one or at least one, and the singular also includes the plural unless it is clearly indicated otherwise.

Figure 1:
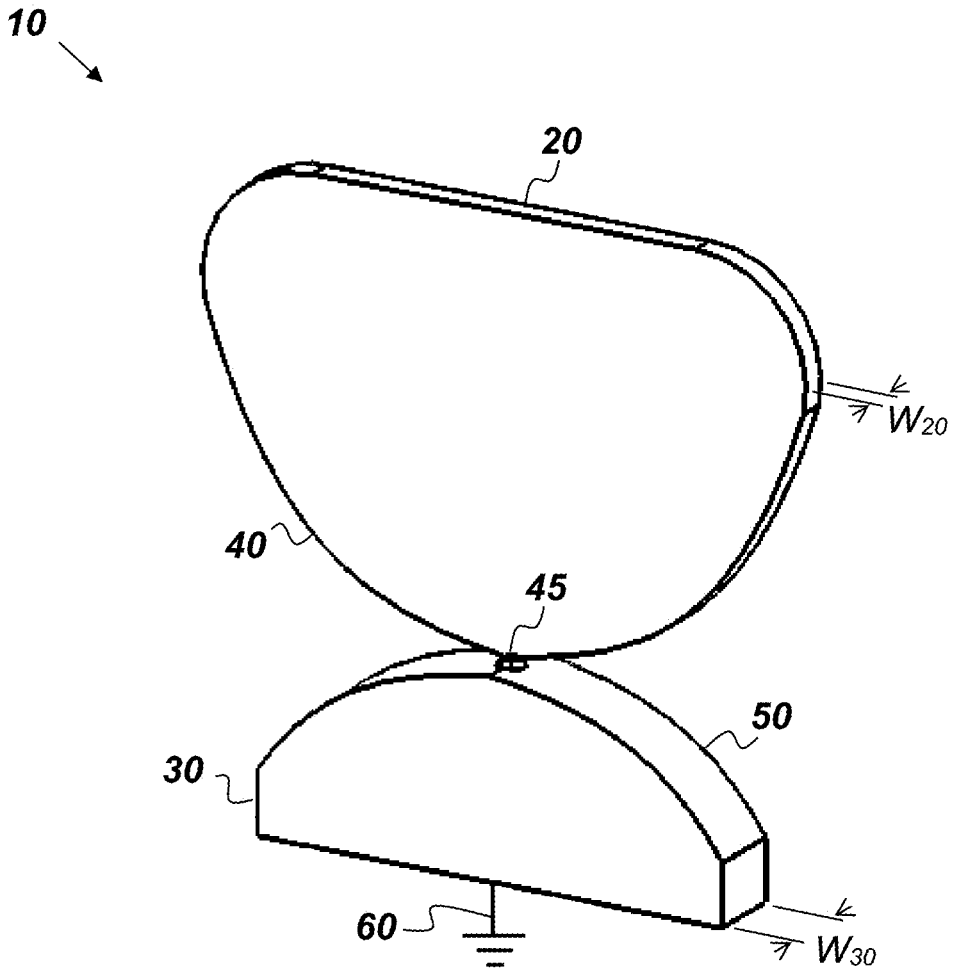
FIG. 1 is a perspective view of an embodiment of a blade antenna.

FIG. 1 is a perspective view of an embodiment of a blade antenna 10 that has been designed to provide uniform azimuthal gain patterns over a wide bandwidth. The blade antenna 10 comprises, consists of, or consists essentially of upper and lower blade elements 20 and 30 respectively. The upper and lower blade elements 20 and 30 are capable of transmitting and receiving RF energy. As shown in FIG. 1, the upper and lower blade elements 20 and 30 are situated in a tapered slot antenna configuration. A width $W_{30}$ of the lower blade element 30 is at least three times a width $W_{20}$ of the upper blade element 20. The upper and lower blade elements 20 and 30 may be made of conductive, planar material. In the embodiment of the blade antenna 10 shown in FIG. 1, the upper blade element 20 has a profile 40 that curves upwardly from a centrally-located feed point 45. The lower blade element 30 has a profile 50 that curves downwardly from the feed point 45. The lower blade element 30 is configured to be connected to a ground 60. The curved profiles 40 and 50 of the upper and lower blade elements respectively are disposed with respect to one another so as to form a tapered slot on each side of the feed point 45. The curved profile 40 of the upper blade element 20 may have an exponentially curved shape. Likewise, the curved profile 50 of the lower blade element 30 may have an exponentially-curved shape similar to the shape of profile 40, except inverted.

The upper and lower elements 20 and 30 may be made of any conductive material. They may be 3-dimensionally (3D) printed out of a non-conductive material (e.g., plastic) and then coated with a conductive material. If the upper and lower elements 20 and 30 are fabricated using 3D printing, for example using a plastic material, the upper and lower elements 20 and 30 can be metallized using electroplating, or by covering them with conductive tape, such as Chomerics CHO FOIL, which has a conductive adhesive. If fabricated this way, the blade antenna 10 could handle a few watts in transmit mode. Alternatively, the upper and lower elements 20 and 30 may be manufactured out of metal (e.g., aluminum, copper, etc.). The upper and lower elements 20 and 30 can be made of metal, such as aluminum, and can be fabricated using computer numerically controlled (CNC) machining. If fabricated this way, the blade antenna 10 could handle up to ~100 watts in transmit mode.

Figure 2:
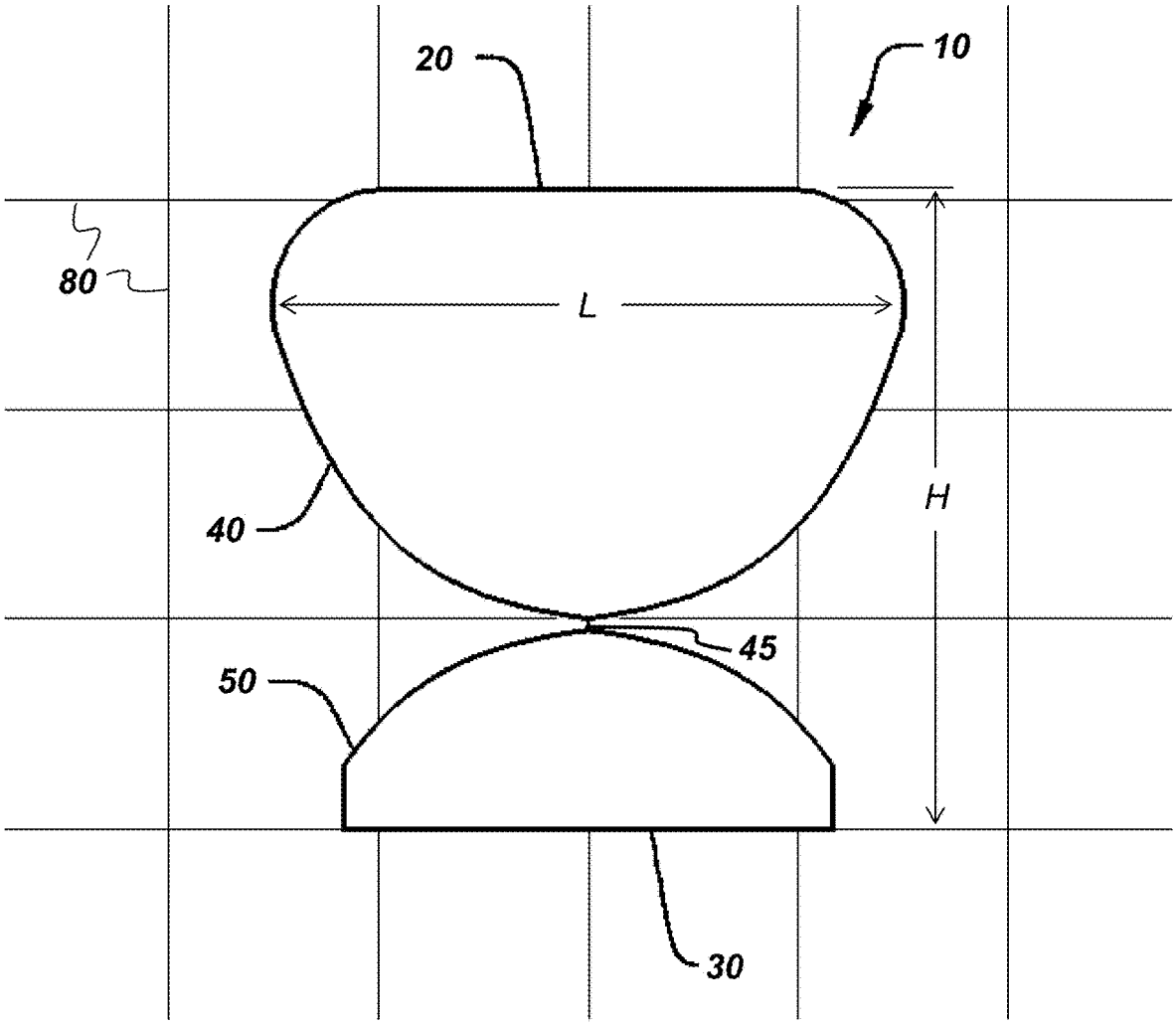
FIG. 2 is a side view of an embodiment of a blade antenna.
Figure 3:
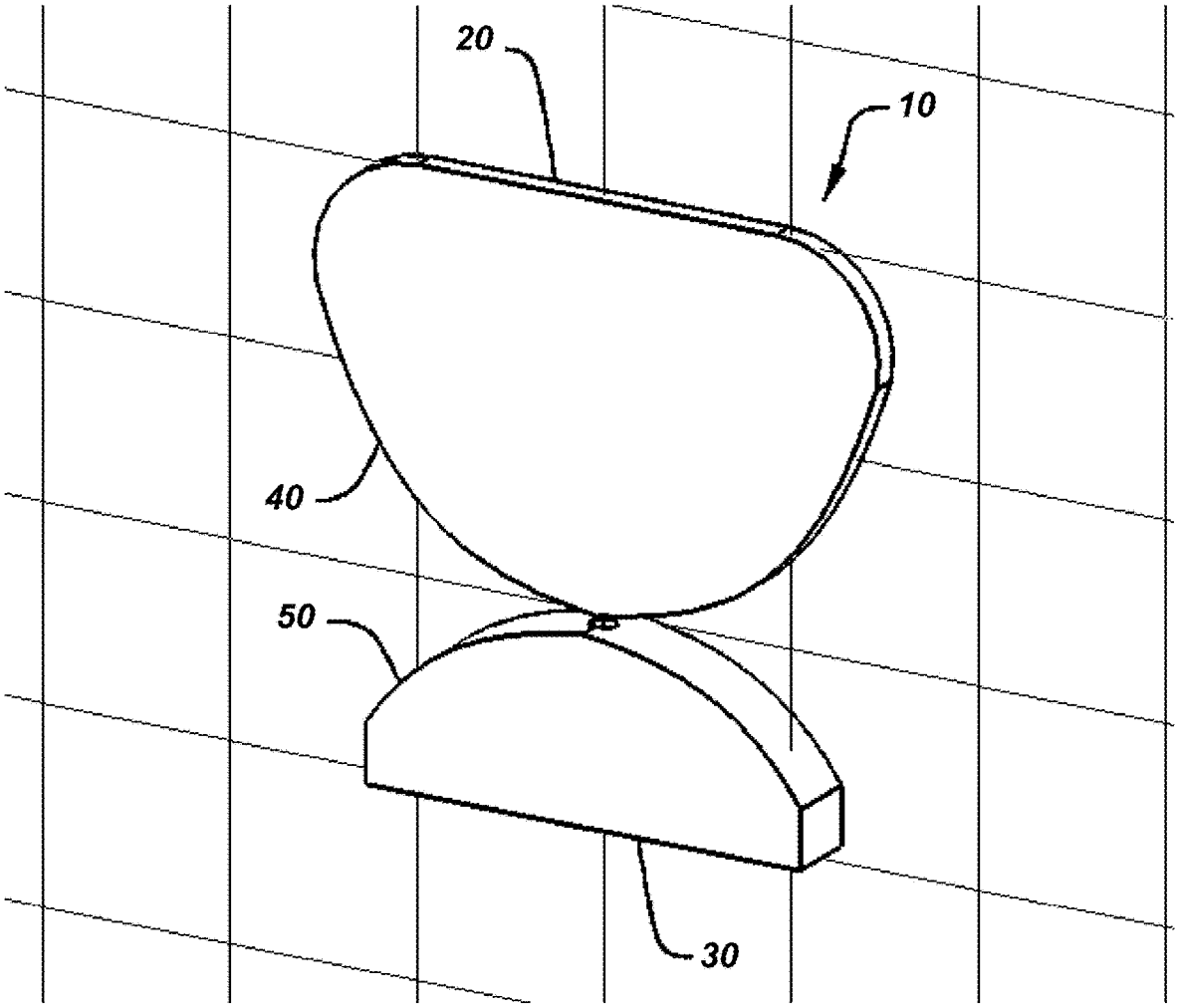
FIG. 3 is a perspective view of an embodiment of a blade antenna.
Figure 4:
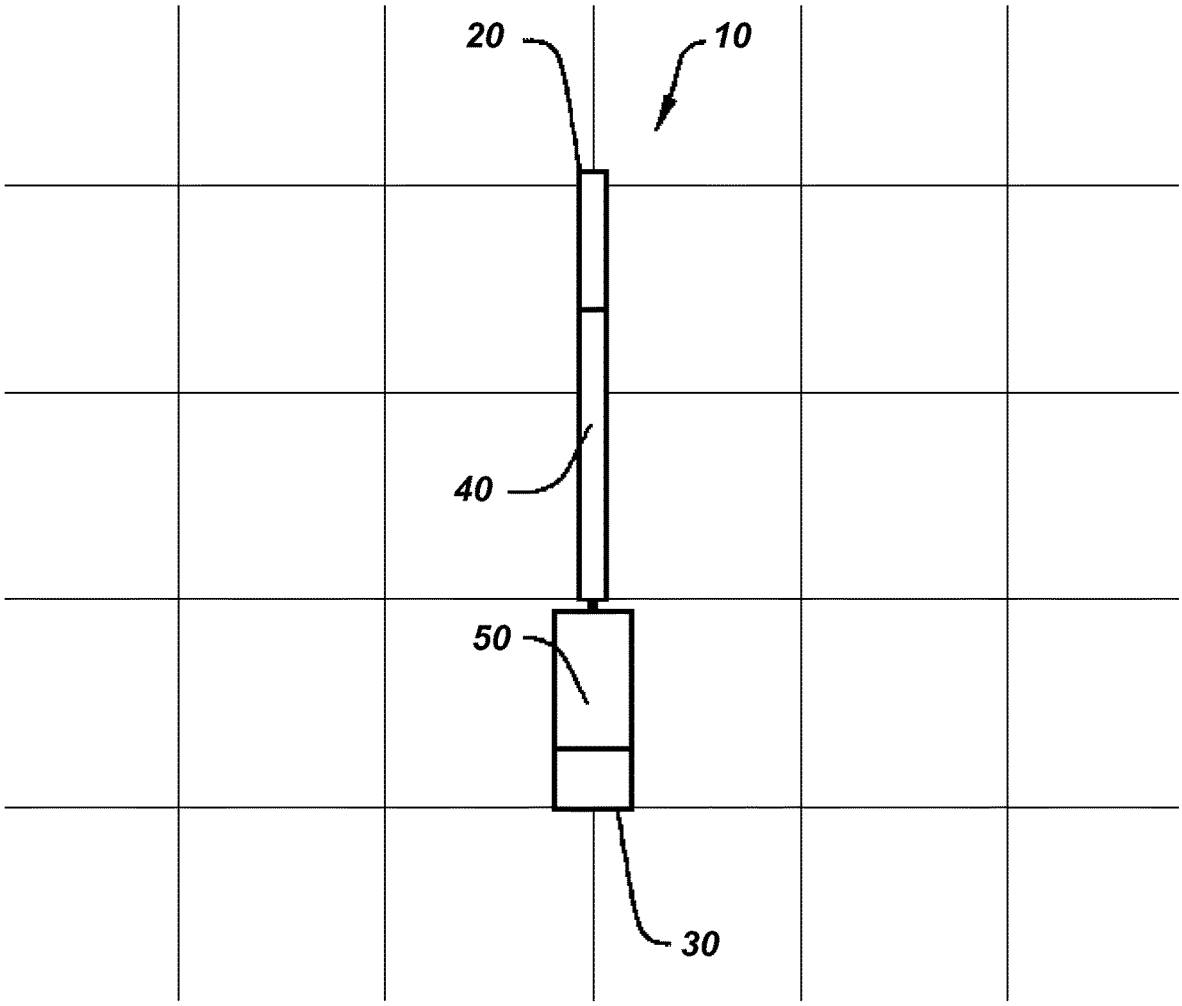
FIG. 4 is an edge view of an embodiment of a blade antenna.
Figure 5:
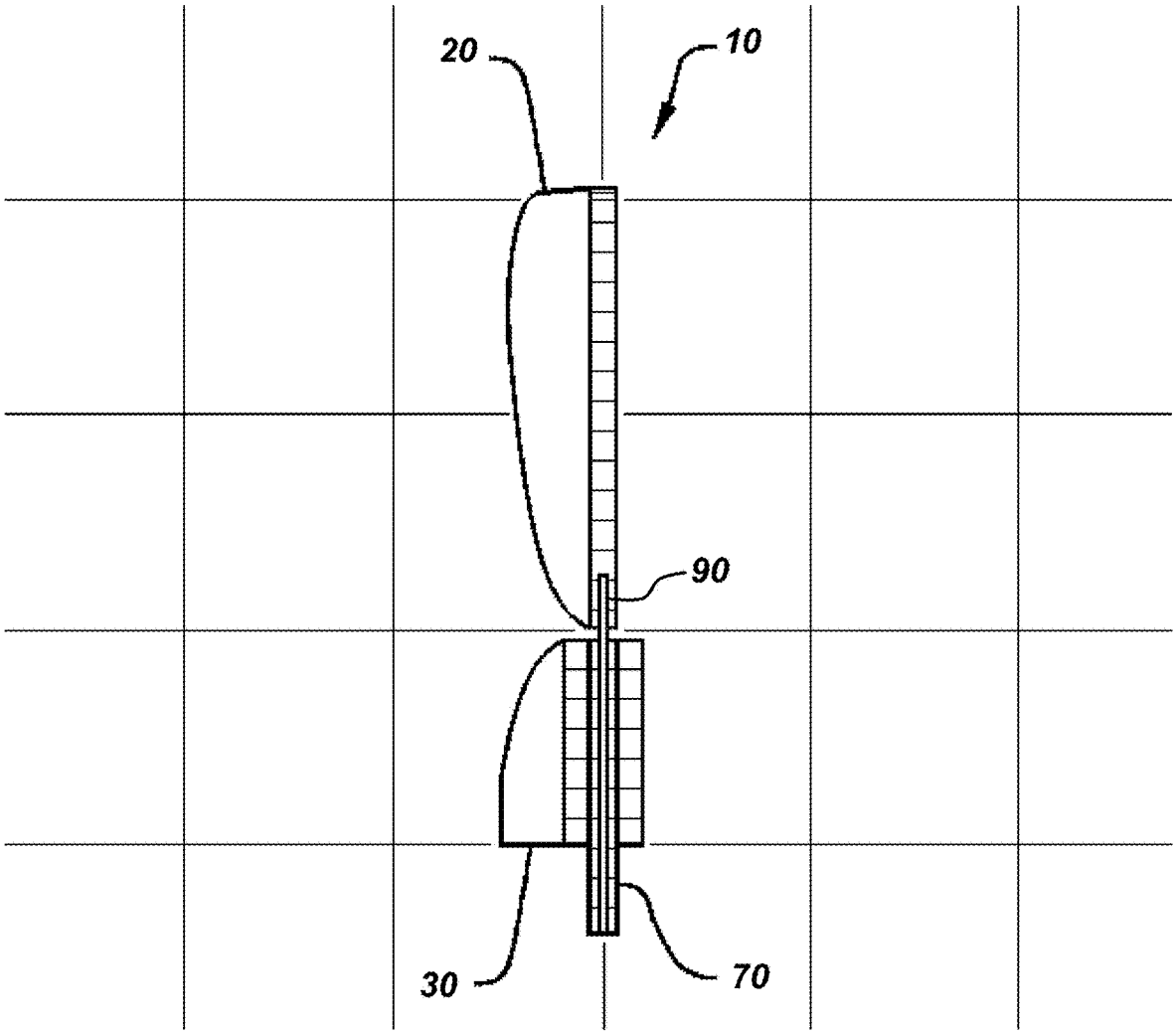
FIG. 5 is cross-sectional, perspective view of an embodiment of a blade antenna.

FIGS. 2, 3, 4, and 5 are illustrations in various views of a particular, example embodiment of the blade antenna 10. FIGS. 2, 3, 4, and 5 include grid lines 80, spaced 2.54 centimeters (1 inch) apart, to show dimensions of this embodiment of the blade antenna 10. FIG. 2 is a side view. FIG. 3 is a perspective view. FIG. 4 is an edge view. FIG. 5 is a cross-sectional, perspective view. In the example embodiment of the blade antenna 10 shown in FIGS. 2 through 5, the overall length L is 7.6581 centimeters (3.015 inches), and the overall height His 7.75208 centimeters (3.052 inches). Also in this example embodiment, the thickness/width $W_{20}$ of the upper blade element 20 is 0.3175 centimeters (0.125 inches), and the thickness/width $W_{30}$ of the lower blade element 30 is 0.9525 centimeters (0.375 inch). In this embodiment of the blade antenna 10, the lower blade element 30 is thick enough such that a coaxial feed line 70 may be routed through the lower blade element 30 (as shown in FIG. 5) to the feed point 45. The upper element 20 may be connected to a center conductor 90 of a coaxial feed line 70 (also shown in FIG. 5).

Figure 6:
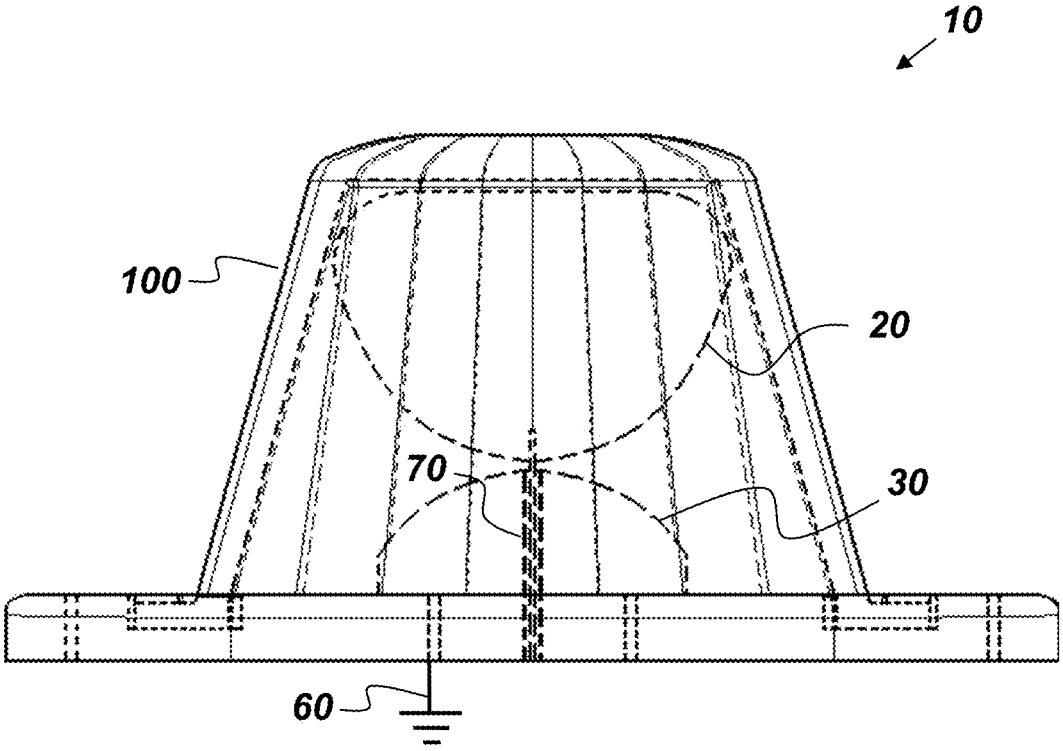
FIG. 6 is a side view of an embodiment of a blade antenna.

FIGS. 6, 7, 8, 9, and 10 are illustrations in various views of a particular example embodiment of the blade antenna 10 that includes an external housing 100, which is RF-transparent and aerodynamic. FIG. 6 is a side-view illustration of this embodiment of the blade antenna 10. The external housing 100 is configured to contain the upper and lower blade elements 20 and 30. The external housing 100 is shown in FIG. 6 as being transparent to facilitate viewing of the upper and lower blade elements 20 and 30, but it is to be understood that the external housing 100 can be transparent to RF energy without being transparent to energy within the visible spectrum. The external housing 100 may be used to provide structural support to the upper blade element 20 so as to maintain the upper blade element 20 in the tapered slot antenna configuration with respect to the lower blade element 30.

Figure 7:
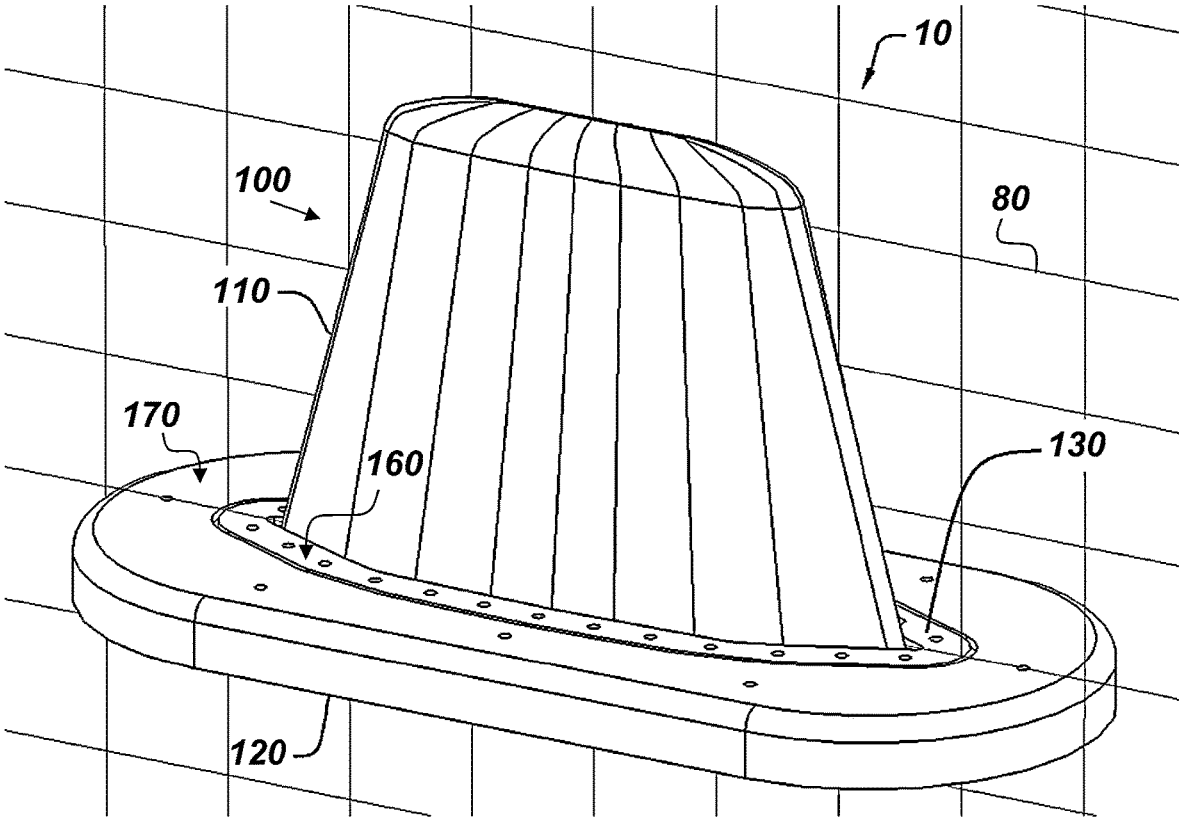
FIG. 7 is a perspective view of an embodiment of a blade antenna.
Figure 8:
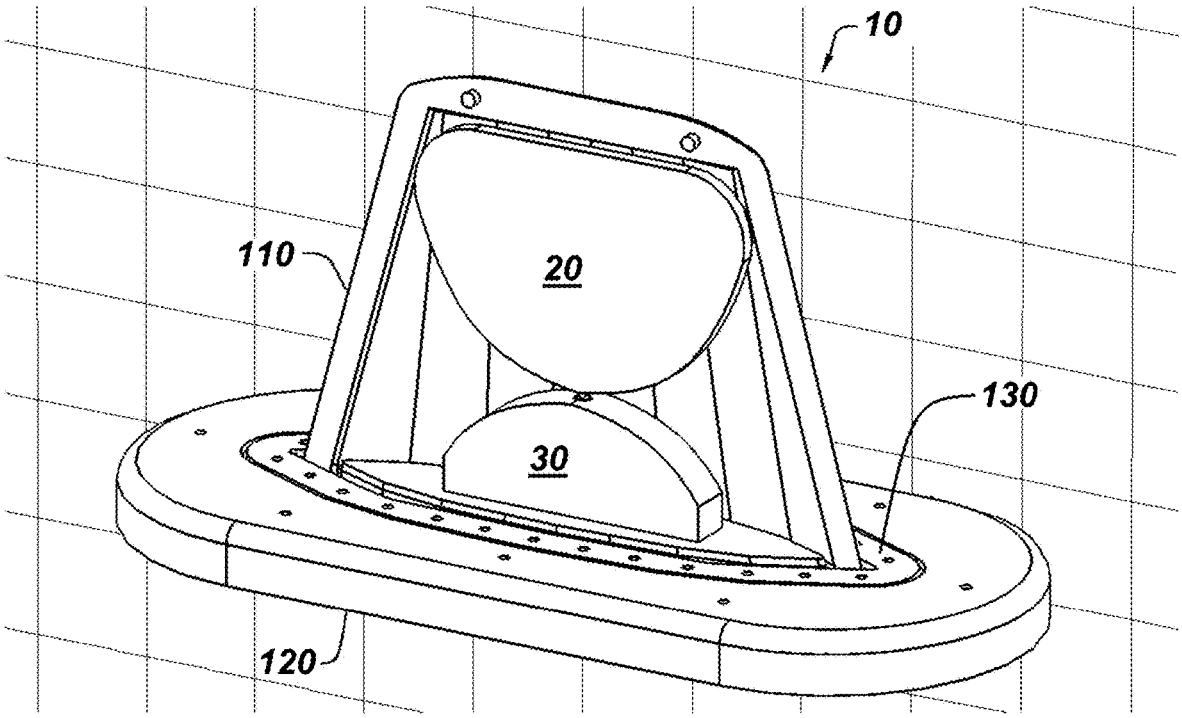
FIG. 8 is a perspective, view of an embodiment of a blade antenna.

FIGS. 7, 8, 9, and 10 include grid lines 80, spaced 2.54 centimeters (1 inch) apart, to show dimensions of this particular embodiment of the blade antenna 10. The embodiment of the external housing 100 shown in FIGS. 6, 7, 8, 9, and 10 comprises an upper housing section 110, a base mounting section 120, and an upper housing mounting ring 130. FIG. 7 is a perspective-view illustration. FIG. 8 is a perspective-view with part of the external housing 100 removed to facilitate viewing of the upper and lower blade elements 20 and 30 contained therein.

Due to the complexity of the shape of the external housing 100, the preferred method for manufacturing the external housing 100 is 3D printing, using low-loss-tangent dielectric materials. Suitable materials from which the external housing 100 may be 3D printed include, but are not limited to, acrylonitrile butadiene styrene (ABS), nylon, polylactic acid (PLA), polyethylene terephthalate (PET), and polypropylene (PP), and high impact polystyrene. Alternatively, external housing 100 could be fabricated using CNC machining, or other suitable manufacturing method, with suitable materials including, but not limited to, fiberglass, plastic, glass fiber-reinforced plastic, aliphatic polymers, polyethylene, polypropylene, polystyrene, and polyurethane. The blade antenna 10 may be mounted to a vehicle, manned or unmanned, such as an automobile, train, spacecraft, or aircraft. It is preferable for the housing 100 to be built strong enough to be able to withstand the stresses of high airspeed such as would be experienced if the antenna 10 were mounted to an aircraft.

Figure 9:
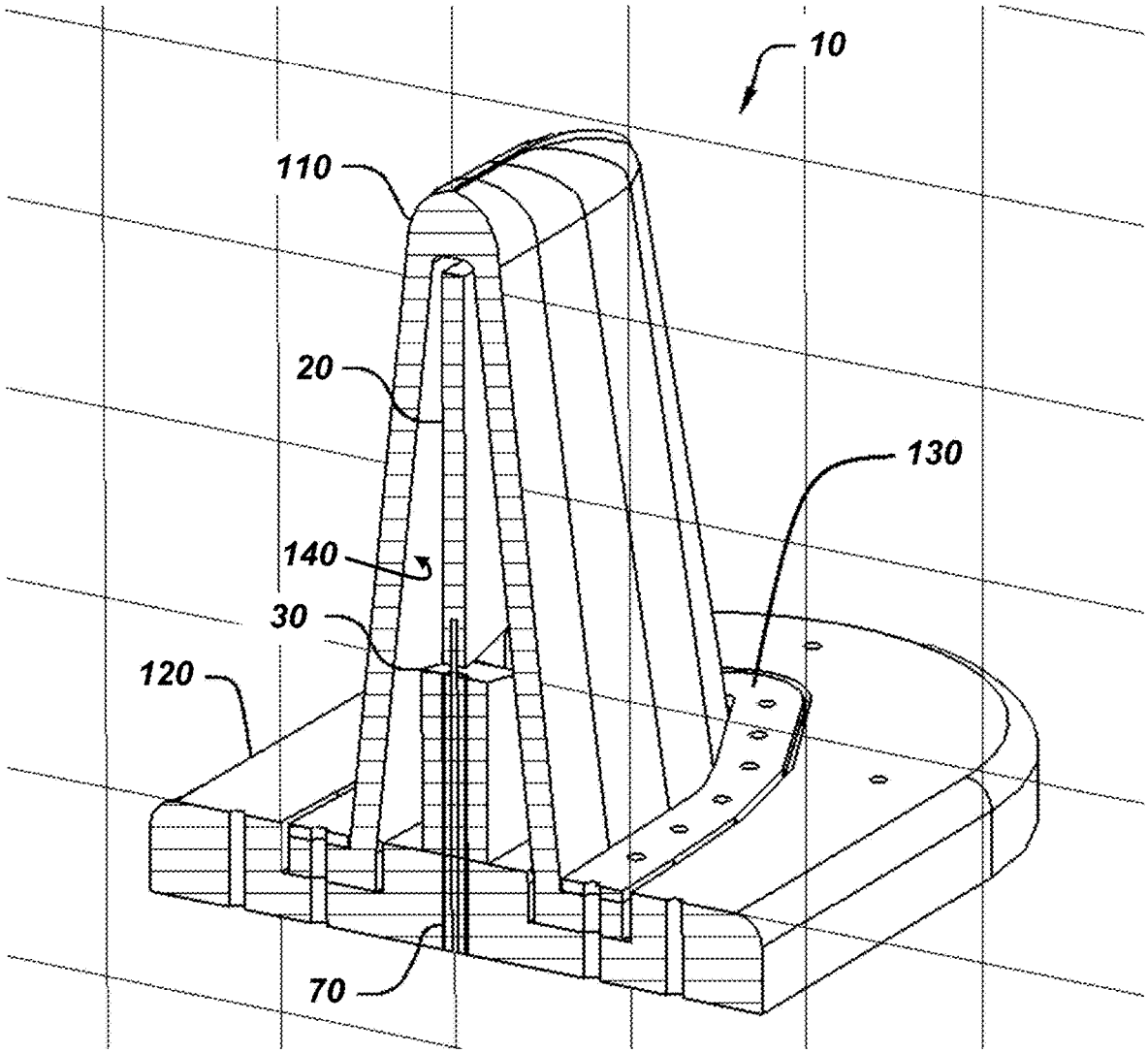
FIG. 9 is cross-sectional, perspective view of an embodiment of a blade antenna.

FIG. 9 is a perspective, cross-sectional view of the example embodiment of the blade antenna 10 shown in FIGS. 6, 7, 8, 9, and 10, with the cutting plane passing from side to side through the center of the blade antenna 10. As can be seen in FIG. 9, in this example embodiment, the lower blade element 30 is mounted to the base mounting section 120 and both the upper and lower blade elements 20 and 30 fit within the external housing 100. Also in this embodiment, the coaxial feed line 70 is fed through the base mounting section 120 and through the lower blade element 30, which is configured to be connected to a ground 60, such as the metal skin of an aircraft. This grounding may be accomplished through an electrically conductive embodiment of the base mounting section 120. The coaxial feed line 70 may serve to connect the blade antenna 10 to a transmitter or receiver inside a vehicle, for example.

With respect to FIGS. 6, 7, 8, 9, and 10, a space between the upper and lower blade elements 20 and 30 and an interior surface 140 of the upper housing section 110 may be filled with a dielectric foam. In the example embodiment of blade antenna 10 shown in FIGS. 6, 7, 8, 9, and 10, a spacing of at least 3.81 millimeters (0.15 inches) exists between all points of the lower blade element 30 and the interior surface 140. The lower blade element 30 may be secured to the mounting base section 120 with fasteners (e.g., screws, bolts, rivets, etc.), by welding, or even with conductive adhesive. Alternatively, the lower blade element 30 and the mounting base section 120 may be fabricated as a single, seamless unit, either through additive or subtractive manufacturing techniques, such as through 3D printing and CNC machining. The upper blade element 20 may be held in its proper location inside the upper housing section 110 by attaching it, with spacers, to the upper housing section 110, or by filling the space inside the upper housing section 110 not occupied by upper and lower blade elements 20 and 30 with low-loss, low-dielectric constant material, examples of which include, but are not limited to, closed cell polyurethane foams, polyimide foams, polyethylene foams and Polymethacrylimide foams.

Figure 10:
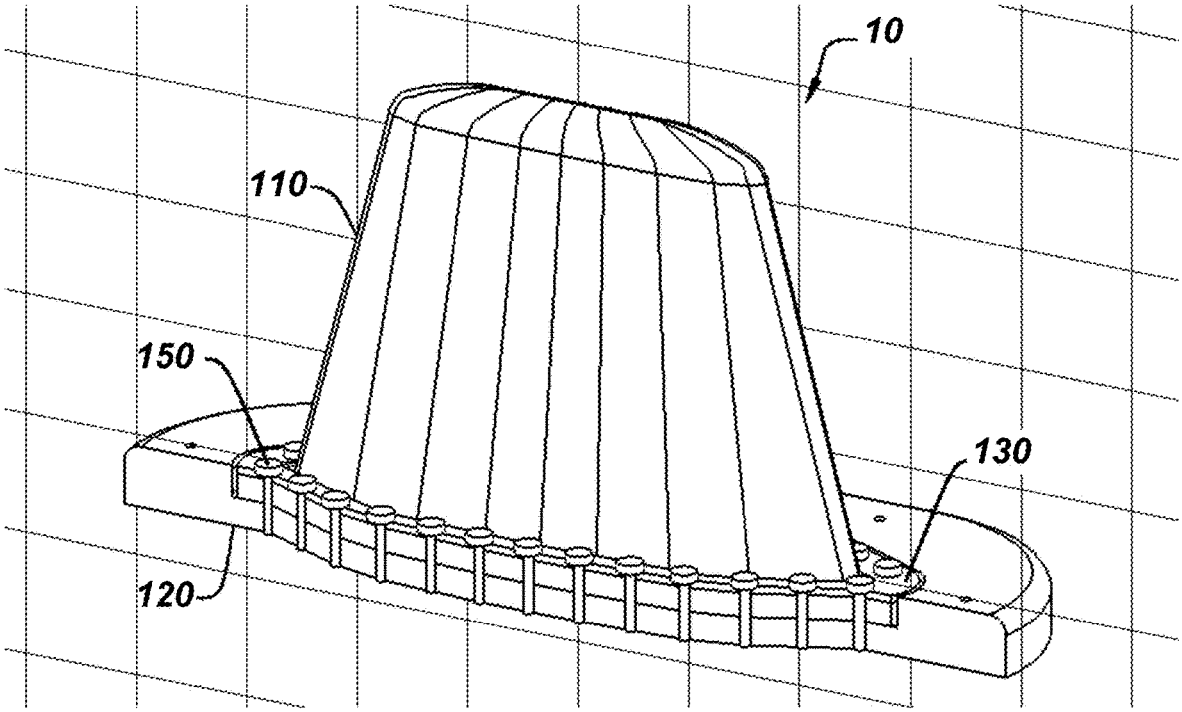
FIG. 10 is partial, perspective view of an embodiment of a blade antenna.

FIG. 10 is a partial, perspective-view showing an embodiment of fasteners 150 that may be used to secure the upper housing section 110 and the upper housing mounting ring 130 to the base mounting section 120. FIG. 10 shows a view of an example of a segment of the mounting area with the mounting fasteners 150. In FIG. 10, portions of the upper housing section 110, upper housing mounting ring 130, and the mounting base section 120 have been removed to show the fasteners 150, which in one suitable embodiment, may be screws of possible sizes 4-40 or 6-32. The fasteners 150 could, for example, be made of nylon or steel. For high mechanical strength to withstand high velocities, steel fasteners could be used. Similarly, the upper housing mounting ring 130 could be made of composite material or metal, such as steel. The fasteners 150 could be flat head screws, with their mounting holes in upper housing mounting ring 130 countersunk. This would provide a further reduction of the wind resistance of the external housing 100.

It is preferable to reduce disturbances to the antenna patterns caused by resonances of the RF currents on the fasteners 150 and the upper housing mounting ring 130. These resonances could be reduced and moved out of the operating frequency range of the blade antenna 10 by increasing the number of fasteners 150 and reducing the spacing between them, and by lowering the bottom mounting rim of the upper housing section 110 into mounting base 120, as shown, for example, in FIG. 7 so that an upper surface 160 of the upper housing mounting ring 130 is flush with an upper surface 170 of the mounting base 120. In the examples shown in FIGS. 6, 7, 8, 9, and 10, the spacing between adjacent fasteners 150 has been reduced to between 11.176 mm (0.44 in) and 12.446 mm (0.49 in).

FIGS. 11A, 11C, 11E, 12A, 12C, and 12E are plots of realized gain of the embodiment of the blade antenna 10 shown in FIG. 6 at various frequencies and show patterns of the realized gain of the aircraft blade versus azimuth at the horizon. These plots of the gain of the blade antenna 10 show remarkably little variation versus azimuth angle and shows their gain is very constant versus azimuth. FIGS. 11B, 11D, 11F, 12B, 12D, and 12F are plots that show patterns of the realized gain of the embodiment of the blade antenna 10 shown in FIG. 6 versus elevation angle at various frequencies. The solid curves represent the gain versus elevation when measured from one edge of the blade antenna 110 (such as is shown in FIG. 4) to the other edge. The dashed curves represent the gain versus elevation measured from one side of the blade antenna 10 (such as is shown in FIG. 6) to the opposite side.

Figure 11A:
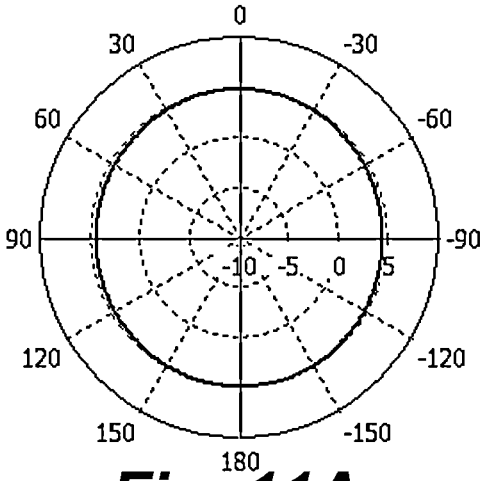
FIGS. 11A, 11C, 11E, 12A, 12C, and 12E are plots of realized gain of an embodiment of a blade antenna vs azimuth angle at various frequencies.
Figure 11B:
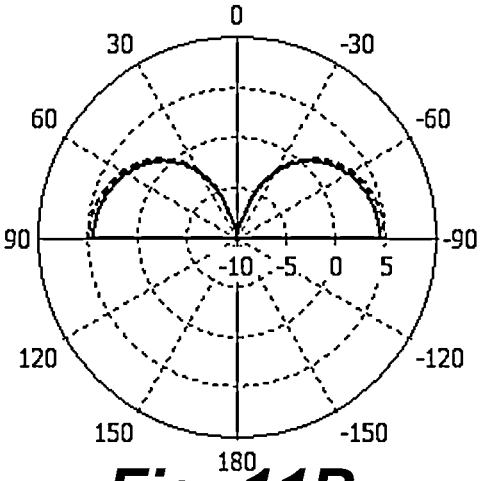
FIGS. 11B, 11D, 11F, 12B, 12D, and 12F are plots of the realized gain of an embodiment of a blade antenna versus elevation angle at various frequencies.
Figure 11C:
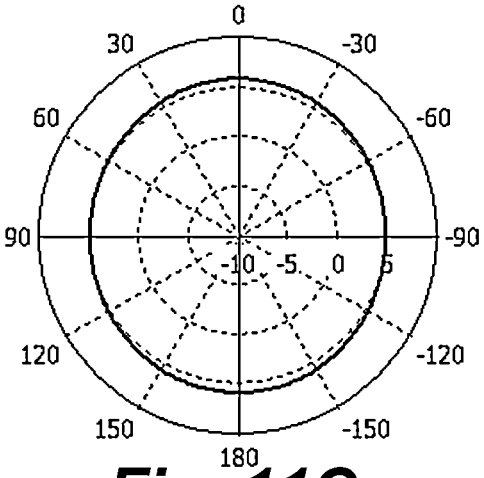
Figure 11D:
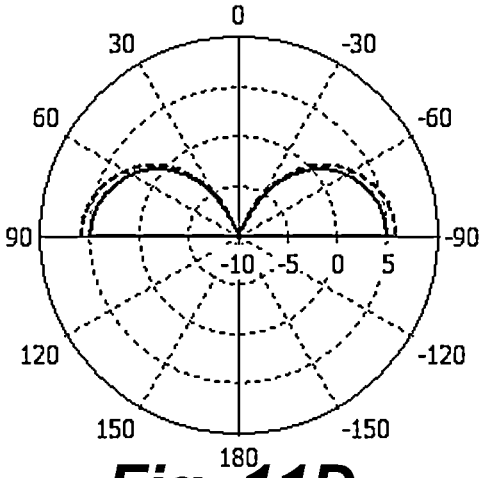
Figure 11E:
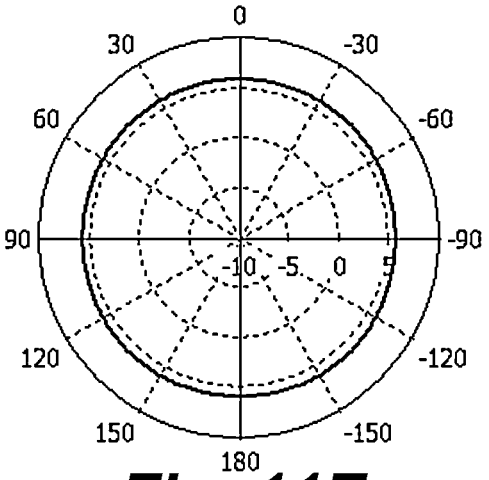
Figure 11F:
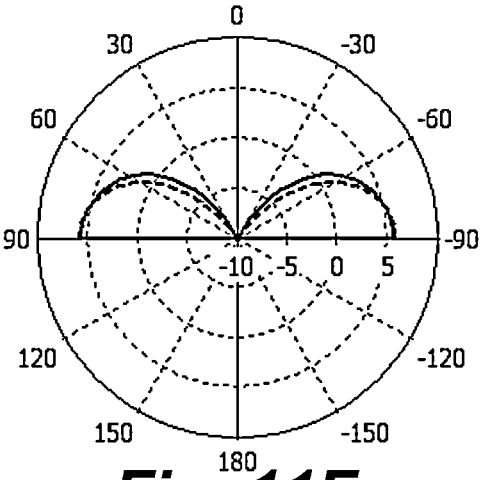
Figure 12A:
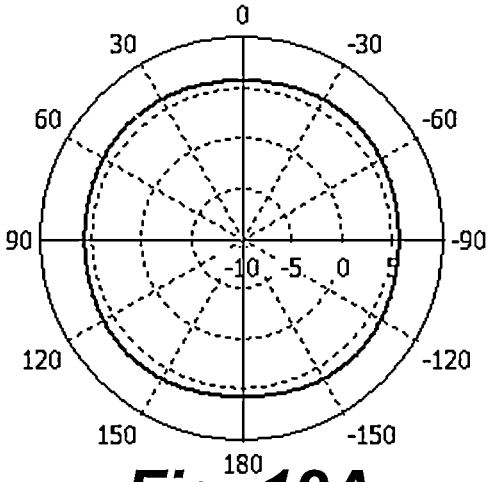
Figure 12B:
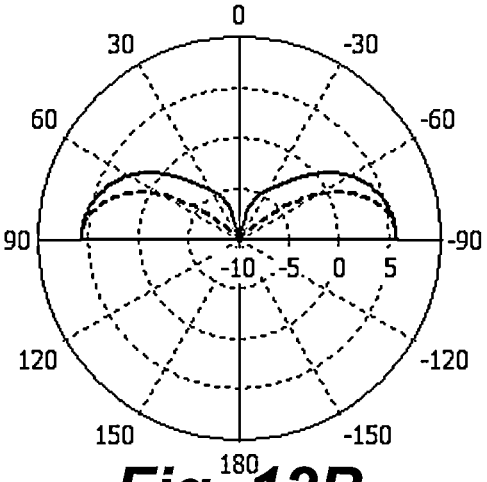
Figure 12C:
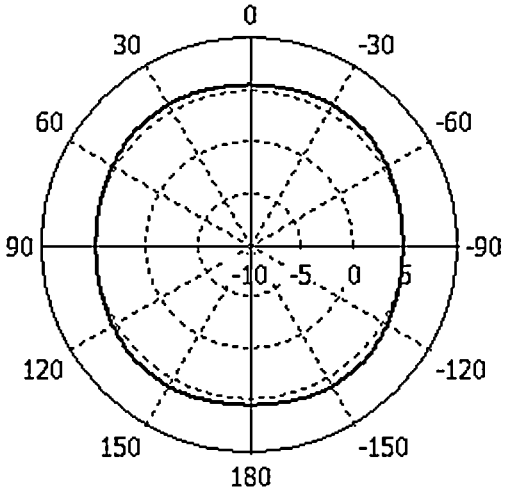
Figure 12D:
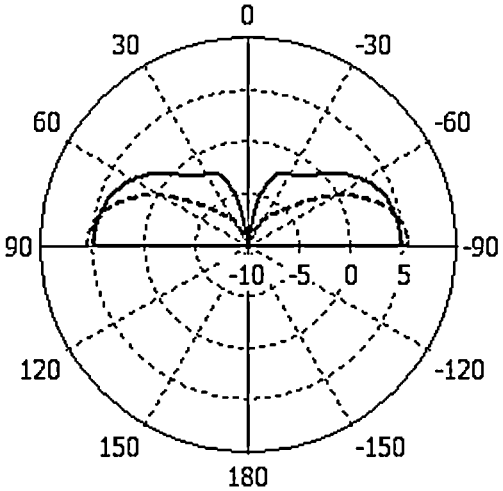
Figure 12E:
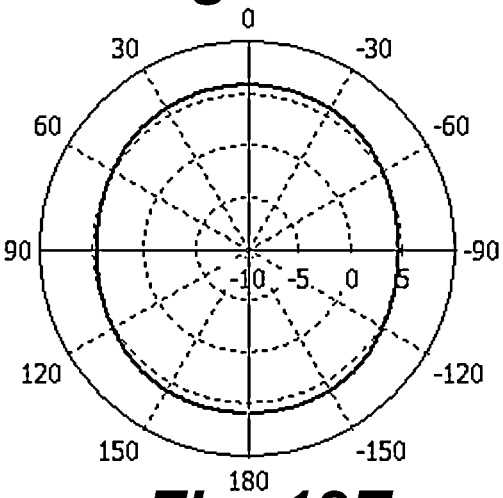
Figure 12F:
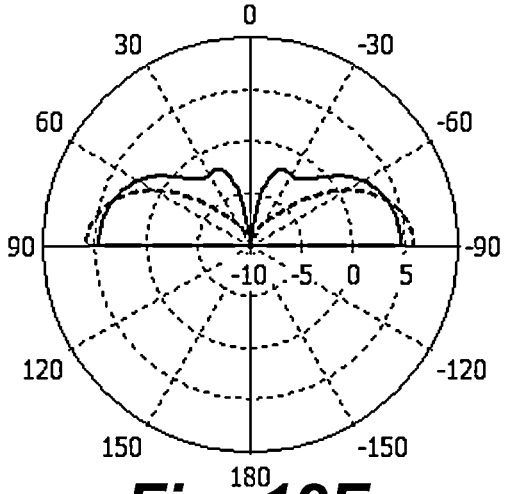

FIGS. 11A and 11B are a set of plots of the realized gain (max 4.79 dB) of the antenna vs azimuth and elevation angles at 600 MHz. FIGS. 11C and 11D represent a set of plots of the realized gain (max 5.74 dB) of the antenna vs azimuth and elevation angles at 1088 MHz. FIGS. 11E and 11F represent a set of plots of the realized gain (max 5.79 dB) of the antenna vs azimuth and elevation angles at 1480 MHz. FIGS. 12A and 12B represent a set of plots of the realized gain (max 6.02 dB) of the antenna vs azimuth and elevation angles at 1850 MHz. FIGS. 12C and 12D represent a set of plots of the realized gain (5.65 dB max) of the antenna vs azimuth and elevation angles at 2150 MHz. FIGS. 12E and 12F respectively represent plots of the realized gain (7.74 dB max) of the antenna vs azimuth and elevation angles at 2300 MHz.

Figure 13:
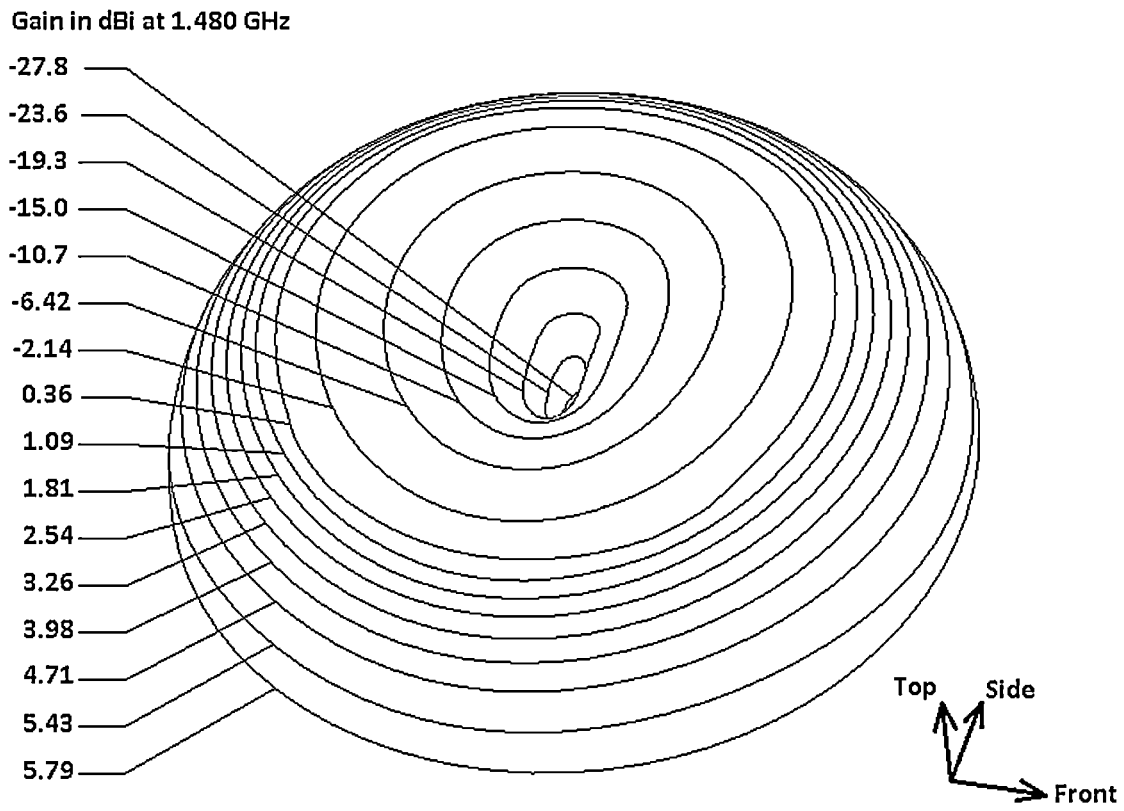
FIG. 13 is a three-dimensional plot of the realized gain of an embodiment of a blade antenna.

FIG. 13 is a three-dimensional plot of the realized gain of the embodiment of the blade antenna 10 as depicted in FIG. 6 at 1480 MHz. Note that the plot in FIG. 13 of the gain of this embodiment of the blade antenna 10 shows that maximum and minimum values of the gain versus azimuth are within 1 dB of each other for all elevation angles from the horizon up to 28 degrees. Three-dimensional plots of the gain of this embodiment of the blade antenna 10 at other frequencies in its operating range show very similar uniform gain patterns.

Figure 14:
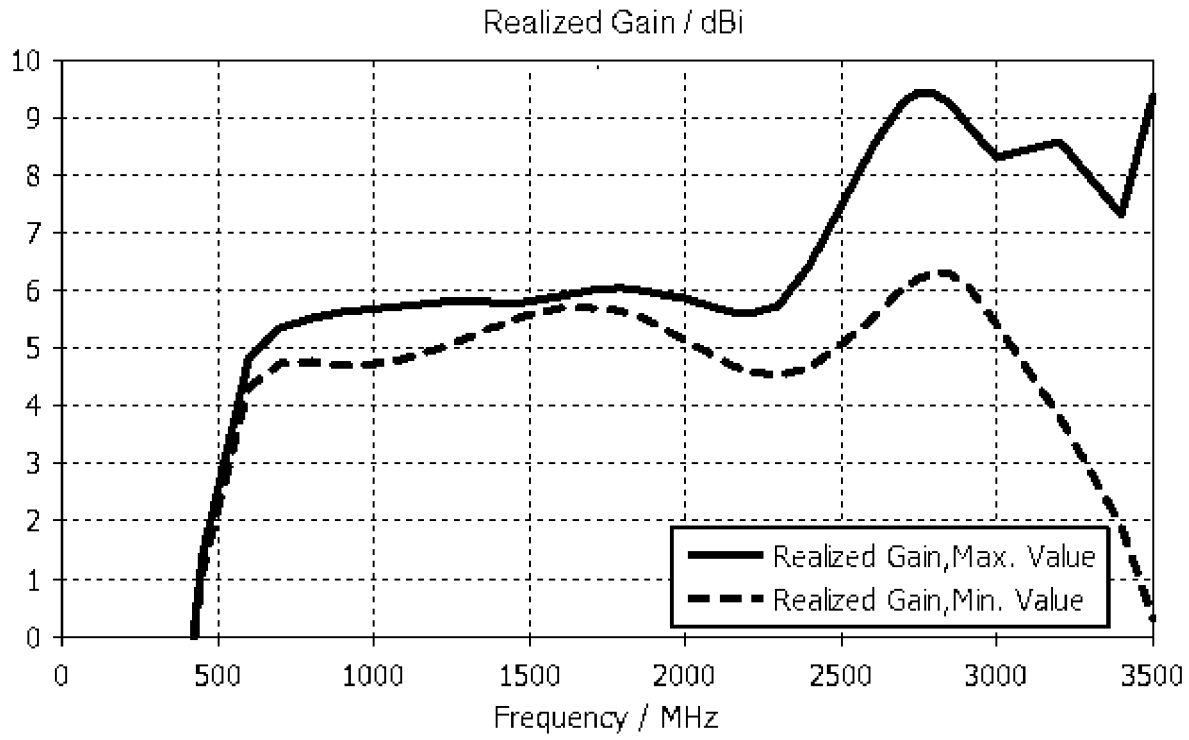
FIG. 14 shows plots of the minimum and maximum gains versus frequency of an embodiment of a blade antenna.

FIG. 14 shows plots of the minimum and maximum gains versus frequency of the previously described example antenna. These plots show a very small variation in gain versus azimuth, with the minimum and maximum gains being within 1 dB of each other over a 4:1 frequency range, in this example 540 to 2170 MHz, and the minimum gain exceeding three dBi over a 6:1 frequency range, in this example 540 to 3280 MHz. As shown in the gain patterns of FIG. 11A through FIG. 13, and the plots of minimum and maximum gain in FIG. 14, embodiments of the blade antenna 10 have uniform gain versus azimuth angle over a wide bandwidth, with the minimum and maximum gains being within 1 dB of each other over a nearly 4:1 frequency range. FIG. 14 also shows that the gain at the horizon exceeds three dBi at all azimuth angles over a wide bandwidth with a nearly 6:1 frequency range.

If embodiments of the blade antenna 10 are mounted on a small ground surface (i.e., with dimensions less than one square meter), one can reduce negative effects by increasing the ratio of the size of the ground plane to the size of the embodiment of the blade antenna 10. This can be done by reducing the size of the embodiment of the blade antenna 10 to a minimum size that will cover the required frequency range. The blade antenna 10 can provide the same azimuthally uniform omnidirectional gain patterns over a similarly wide frequency range as a bicone antenna, while occupying only a fraction of the volume. For embodiments of the blade antenna 10 that are operated without a housing, the lower blade element 30 may be connected to a ground, while the upper blade element 20 may be mechanically supported, for example, by plastic foam, to maintain its position with respect to the lower blade element 30. Any suitable means may be used to secure the upper and lower blade elements 20 and 30 in position with respect to each other. In some embodiments, the lower blade element 30 may be secured to the base mounting section 120 with fasteners that pass up through the base mounting section 120 and are threaded into a bottom of the lower blade element 30. In some embodiments, the upper blade element 20 could be held in place with screws that pass through the upper housing section 110 and through the upper blade element 20. In other embodiments, the upper blade element 20 may be held in place with support pins or pegs, that project from near a top of the interior surface 140, in lieu of, or in addition to dielectric foam.

Figure 15A:
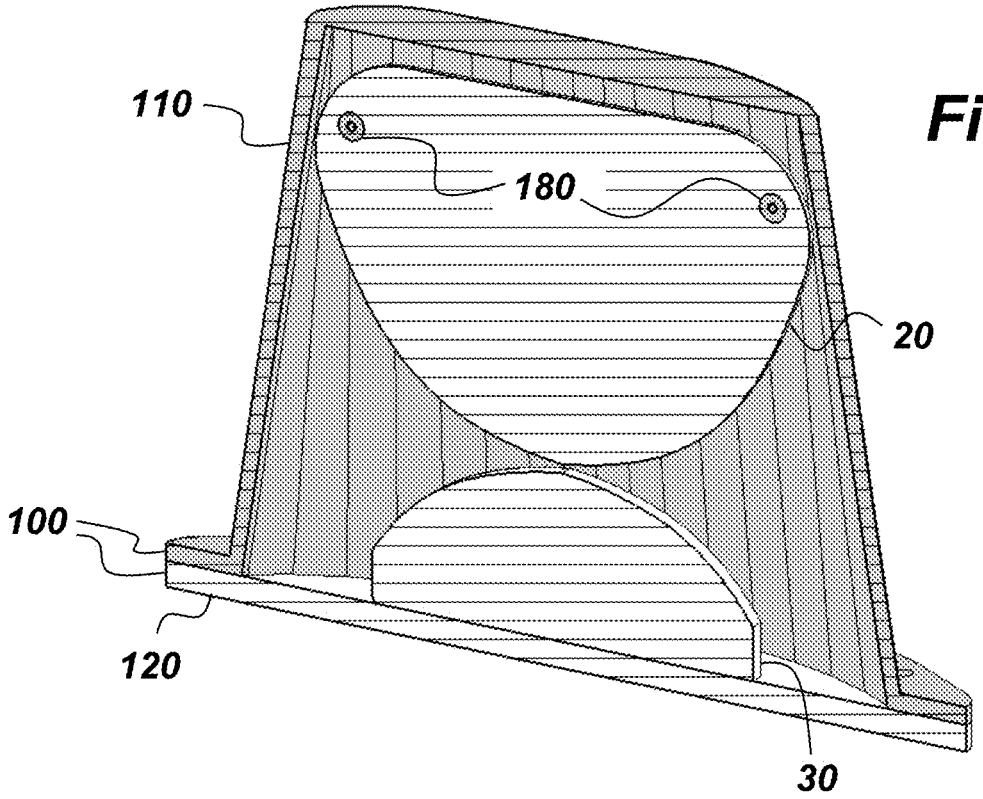
FIG. 15A is a perspective, cross-sectional view of an embodiment of a blade antenna.
Figure 15B:
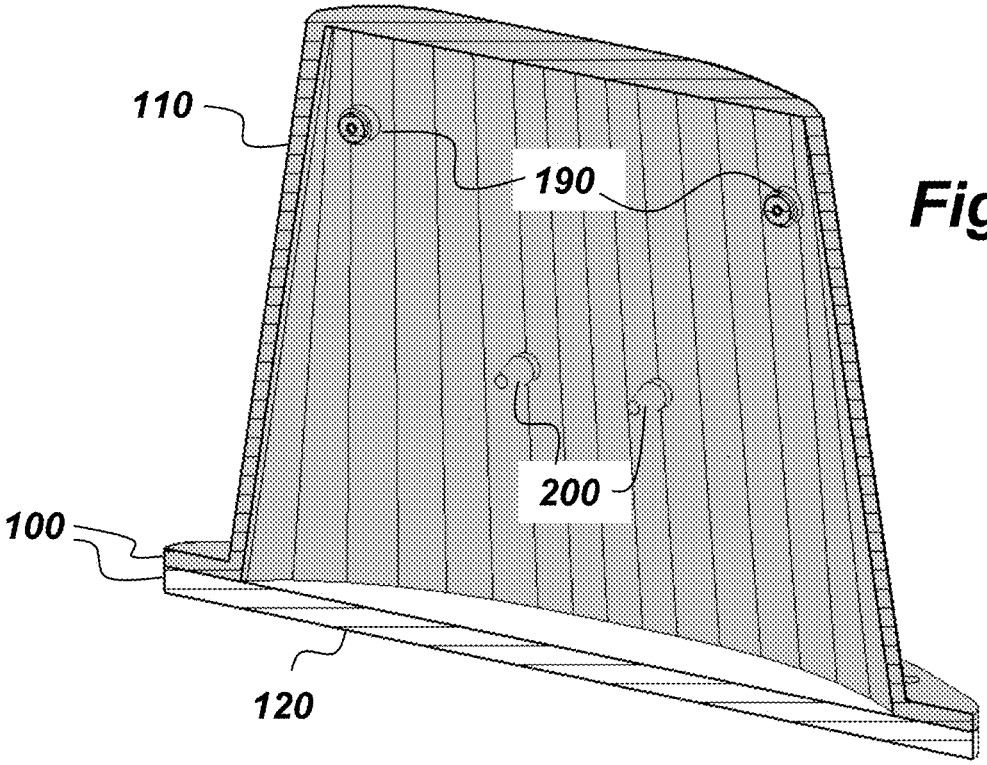
FIG. 15B is a perspective, cross-sectional view of an embodiment of an external housing.

FIG. 15A is a perspective, cross-sectional view of an embodiment of the blade antenna 10 where the upper housing section 110 comprises inner mounting fixtures 180 designed to hold the upper blade element 20 in place. The mounting fixtures 180 may be used to keep the upper blade element 20 in position with respect to the lower blade element 30 without the use of any dielectric foam. FIG. 15B is a perspective, cross-sectional view of the embodiment of the external housing 100 shown in FIG. 15A showing that the mounting fixtures 180 may comprise upper mounting fixtures 190 and lower mounting fixtures 200. The upper mounting fixtures 190 may pass through holes in the upper blade element 20 as shown in FIG. 15A. In some embodiments, the upper housing section 110 may comprise two halves, each half having upper mounting fixtures 190 and lower mounting fixtures 200. In such embodiments, the upper mounting fixtures 190 may be configured to accommodate fasteners (e.g., screws, bolts, pins, etc.) to hold the two halves of the upper housing section 110 together. Adhesives may also be used to secure the two halves of the upper housing section 110 together in embodiments where the upper housing section 110 comprises two halves.

From the above description of the blade antenna 10, it is manifest that various techniques may be used for implementing the concepts of the blade antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that blade antenna 10 is not limited to the particular embodiments described herein, but is capable of many embodiments without departing from the scope of the claims.

I claim:

1. A blade antenna comprising:

an upper blade element having a uniform width and capable of transmitting and receiving radio frequency (RF) energy; and a lower blade element having a uniform width and capable of transmitting and receiving RF energy, wherein the upper and lower blade elements are situated in a tapered slot antenna configuration, and wherein the width of the lower blade element is at least three times the width of the upper blade element.

2. The blade antenna of claim 1, further comprising an RF-transparent, aerodynamic, external housing configured to contain the upper and lower blade elements.

3. The blade antenna of claim 2, wherein the external housing provides structural support to the upper blade element so as to maintain the upper blade element in the tapered slot antenna configuration with respect to the lower blade element.

4. The blade antenna of claim 3, wherein a space between the upper and lower blade elements and an inside surface of the external housing is filled with a dielectric foam.

5. The blade antenna of claim 4, wherein each of the upper and lower blade elements comprises an exponentially curved profile section that forms a tapered slot of the tapered slot antenna configuration.

6. A blade antenna comprising:

an upper blade element made of conductive, planar material having a uniform thickness and a profile that curves upwardly from a centrally-located feed point; and a lower blade element made of conductive, planar material having a uniform thickness and a profile that curves downwardly from the feed point, wherein the lower blade element is configured to be connected to a ground and has a thickness that is at least three times a thickness of the upper blade element, and wherein the curved profiles of the upper and lower blade elements are disposed with respect to one another so as to form a tapered slot on each side of the feed point.

7. The blade antenna of claim 6, further comprising an RF-transparent, aerodynamic, external housing configured to contain the upper and lower blade elements.

8. The blade antenna of claim 7, wherein the external housing provides structural support to the upper blade element so as to maintain the tapered slot between the upper and the lower blade elements.

9. The blade antenna of claim 8, wherein a first space exists between the upper blade element and an inner surface of the external housing and a second space exists between the lower blade element and the inner surface of the external housing, and wherein the first and second spaces are filled with a dielectric foam.

10. The blade antenna of claim 9, wherein the external housing comprises an upper housing section and a base mounting section.

11. The blade antenna of claim 10, wherein the base mounting section is conductive and has a width that is at least eight times the width of the lower blade element.

12. The blade antenna of claim 11, wherein the base mounting section is configured to be attached to a conductive surface with nonconductive fasteners.

13. The blade antenna of claim 11, wherein the base mounting section is configured to be attached to a conductive surface with conductive fasteners.

14. The blade antenna of claim 13, wherein the conductive fasteners are countersunk, flathead screws.

15. The blade antenna of claim 14, wherein a spacing between neighboring conductive fasteners is less than 12.5 millimeters.

16. The blade antenna of claim 10 wherein the second space consists of a minimum spacing of 3.8 millimeters between the lower blade element and an inner surface of the upper housing section.

17. The blade antenna of claim 6, wherein each of the profiles of the upper and lower blade elements comprises an exponentially-curved section.

18. The blade antenna of claim 17, wherein each of the profiles of the upper and lower blade elements comprises two exponentially-curved sections that meet together to form an angle at the feed point.

19. The blade antenna of claim 6, further comprising a coaxial feedline routed through a hole in the lower blade element to the feed point that is situated between the upper and lower blade elements.

20. The blade antenna of claim 6, wherein the upper and lower blade elements are made of metal.

* * * * *